US007885565B2

(12) United States Patent
Sasaki et al.

(10) Patent No.: US 7,885,565 B2
(45) Date of Patent: Feb. 8, 2011

(54) DEVELOPMENT DEVICE, IMAGE FORMING APPARATUS AND IMAGE FORMING METHOD

(75) Inventors: Tsutomu Sasaki, Matsumoto (JP); Kazuhiro Nishiyama, Shiojiri (JP); Akihiro Gomi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 72 days.

(21) Appl. No.: 12/405,673

(22) Filed: Mar. 17, 2009

(65) Prior Publication Data

US 2009/0245833 A1 Oct. 1, 2009

(30) Foreign Application Priority Data

Mar. 26, 2008 (JP) ..... 2008-080316
Dec. 17, 2008 (JP) ..... 2008-320710

(51) Int. Cl.
*G03G 15/10* (2006.01)

(52) U.S. Cl. ..... 399/57; 399/237

(58) Field of Classification Search ..... 399/57, 399/237, 249, 58, 358
See application file for complete search history.

(56) References Cited

U.S. PATENT DOCUMENTS 6,542,704 B2 * 4/2003 Suetsugu ..... 399/57
6,580,879 B2 * 6/2003 Coleman et al. ..... 399/27
6,640,073 B2 * 10/2003 Kurotori et al. ..... 399/237
6,987,941 B2 * 1/2006 Takeuchi et al. ..... 399/237
2003/0231903 A1 * 12/2003 Kim ..... 399/237
2004/0253021 A1 * 12/2004 Park ..... 399/237
2005/0053398 A1 * 3/2005 Kim et al. ..... 399/237
2009/0023089 A1 * 1/2009 Teshima et al. ..... 399/237 X
2009/0123167 A1 * 5/2009 Tanaka ..... 399/57
2009/0196657 A1 * 8/2009 Okumura et al. ..... 399/237

FOREIGN PATENT DOCUMENTS

JP 2001-125383 5/2001

* cited by examiner

*Primary Examiner*—Sophia S Chen
(74) *Attorney, Agent, or Firm*—DLA Piper LLP (US)

(57) ABSTRACT

A development device includes a developer carrier 20Y that carries liquid developer containing toner liquid and carrier liquid, a developer supply member 32Y that supplies liquid developer to the developer carrier 20Y, a developer carrier cleaning member 21Y that collects liquid developer from the developer carrier 20Y, a collection reservoir 31*b*Y that stores the liquid developer collected by the developer carrier cleaning member 21Y, a supply section 31*a*Y that makes liquid developer flow to the collection reservoir 31*b*Y, a conveyance member 34Y that conveys the liquid developer collected in the collection reservoir 31*b*Y in a first direction X and a conveyance capacity regulation section 100 that regulates the conveyance capacity of the conveyance member 34Y.

11 Claims, 12 Drawing Sheets

DEVELOPMENT DEVICE, IMAGE FORMING APPARATUS AND IMAGE FORMING METHOD

CROSS REFERENCE TO RELATED APPLICATIONS

This application is based upon and claims the benefit of priority from prior Japanese Patent Applications No. 2008-080316 filed Mar. 26, 2008, and No. 2008-320710 filed Dec. 17, 2008, the entire contents of which are incorporated herein by reference.

BACKGROUND

1. Technical Field

The present invention relates to a development device, an image forming apparatus and an image forming method that are designed to use liquid developer containing toner in carrier liquid.

2. Related Art

There are known wet type image forming apparatus that are designed to develop an electrostatic latent image formed on an image carrier by means of a liquid developer thin layer formed on a development device and transfer the visualized image onto a recording medium and have a development section that is provided with a developer carrier that supplies a liquid developer thin layer to an image carrier, a developer carrier cleaning section that removes the liquid developer left on the developer carrier after development and a liquid developer containing section that can contain the liquid developer coming from the development section.

The development section has a developer collecting section that collects the undeveloped liquid developer that is removed from the developer carrier and conveys it to the liquid developer containing section (Patent Document 1: JP-A-2001-125383).

However, the technique described in the Patent Document 1 can be accompanied by a problem that the collected liquid developer can stay for a prolonged period of time in the developer collecting section when the collected developer is conveyed to the liquid developer containing section to consequently reduce the effect of agitating and dispersing the developer left after development and the newly added developer. Additionally, the concentration of the liquid developer being conveyed to the liquid developer containing section can fluctuate to a large extent depending on the condition of the collected liquid developer to by turn fluctuate the concentration of the liquid developer in the liquid developer containing section to further reduce the effect of agitation and dispersion.

SUMMARY

In view of the above-identified problem, it is therefore an object of the present invention to provide a development device showing an improved effect of agitating and dispersing the liquid developer in a developer container without requiring addition of one or more members and/or any significant modification of the configuration. Another object of the present invention is to provide an image forming apparatus and an image forming method that can form a high-quality image at low cost. Still another object of the present invention is to provide a development device, an image forming apparatus and an image forming method that can reduce any abrupt fluctuations of the concentration of the liquid developer contained in a developer container.

In an aspect of the present invention, the above objects and other objects of the present invention are achieved by providing a development device including: a developer carrier that carries liquid developer containing toner liquid and carrier liquid; a developer supply member that supplies the liquid developer to the developer carrier; a developer carrier cleaning member that collects the liquid developer from the developer carrier; a collection reservoir that stores the liquid developer collected by the developer carrier cleaning member; a supply section that makes liquid developer flow to the collection reservoir; a conveyance member that conveys the liquid developer collected in the collection reservoir in a first direction; and a conveyance capacity regulation section that regulates of conveyance capacity of the conveyance member.

In another aspect of the present invention, there is provided an image forming apparatus including:

a development section that includes: a developer carrier that carries liquid developer containing toner liquid and carrier liquid; a developer supply member that supplies the liquid developer to the developer carrier; a developer carrier cleaning member that collects the liquid developer from the developer carrier; a collection reservoir that stores the liquid developer collected by the developer carrier cleaning member; a supply section that makes liquid developer flow to the collection reservoir; and a conveyance member that conveys the liquid developer collected in the collection reservoir in a first direction; and a conveyance capacity regulation section that regulates the conveyance capacity of the conveyance member; a latent image carrier that carries a latent image to be developed by the developer carrier; a charging section for electrically charging the latent image carrier; an exposure section for exposing the latent image carrier that is electrically charged by the charging section to light to an image; and a transfer member that transfers a developed image on the latent image carrier that is developed by the development section.

Preferably, an image forming apparatus as defined above further includes: an image information detection section that detects image information; and a concentration determination section of liquid developer that determines a toner concentration of the liquid developer collected by the developer carrier cleaning member according to an outcome of detection of the image information detection section.

Preferably, in an image forming apparatus as defined above, the concentration determination section of liquid developer arithmetically determines the toner concentration of the liquid developer collected by the developer carrier cleaning member according to the outcome of detection of the image information detection section.

Preferably, in an image forming apparatus as defined above, the image information detection section computationally determines an image occupancy ratio by means of the number of dots printed on a single transfer medium.

Preferably, in an image forming apparatus as defined above, the conveyance capacity regulation section regulates the conveyance capacity of the conveyance member according to the toner concentration determined by the concentration determination section of liquid developer.

Preferably, an image forming apparatus as defined above further includes: a speed modification section that is controlled by the conveyance capacity regulation section and regulates a rotational speed of the conveyance member Preferably, an image forming apparatus as defined above further includes: an aperture section that discharges liquid developer from the collection reservoir; and a discharge capacity regulation member that is controlled by the conveyance capacity regulation section and covers the aperture section.

Preferably, in an image forming apparatus as defined above, the discharge capacity regulation member includes: a cap that covers the aperture section; and a cam that drives the cap to move.

Preferably, in an image forming apparatus as defined above, the conveyance member is an auger having a helical blade.

Preferably, an image forming apparatus as defined above further includes: a concentration determination section of liquid developer that measures the concentration of the liquid developer in the collection reservoir and determines the concentration of the liquid developer collected by the developer carrier cleaning member.

In still another aspect of the present invention, there is provided an image forming method including: developing a latent image carried by a latent image carrier and exposed to light by an exposure section by means of a developer carrier; detecting image information when performing an image forming operation of transferring a developed image onto a transfer medium; determining a toner concentration of the liquid developer in a collection reservoir of a developer container according to an outcome of detection of the image information; and controlling a conveyance capacity of the conveyance member that conveys liquid developer from the collection reservoir according to the determined toner concentration.

Preferably, an image forming method as defined above the determining of the toner concentration arithmetically determines the toner concentration of the liquid developer in the collection reservoir of the developer container according to the outcome of detection of the image information.

Thus, a development device according to the present invention can stabilize the concentration because it shows an improved effect of agitating and dispersing the liquid developer in a developer container without requiring addition of one or more members and/or modification of the configuration.

An image forming apparatus according to the present invention can form a high-quality image at low cost because it shows an improved effect of agitating and dispersing the liquid developer in a developer container without requiring addition of one or more members and/or modification of the configuration and can reduce any abrupt fluctuations of the concentration of the liquid developer contained in the developer container.

Still other objects and advantages of the invention will in part be obvious and will in part be apparent from the specification.

The invention accordingly includes the features of construction, combinations of elements and arrangement of parts which will be exemplified in the construction hereinafter set forth and the scope of the invention will be indicated in the claims.

BRIEF DESCRIPTION OF THE DRAWINGS

The invention will be described with reference to the accompanying drawings, wherein like members reference like elements.

DESCRIPTION OF EXEMPLARY EMBODIMENTS

Figure 1:
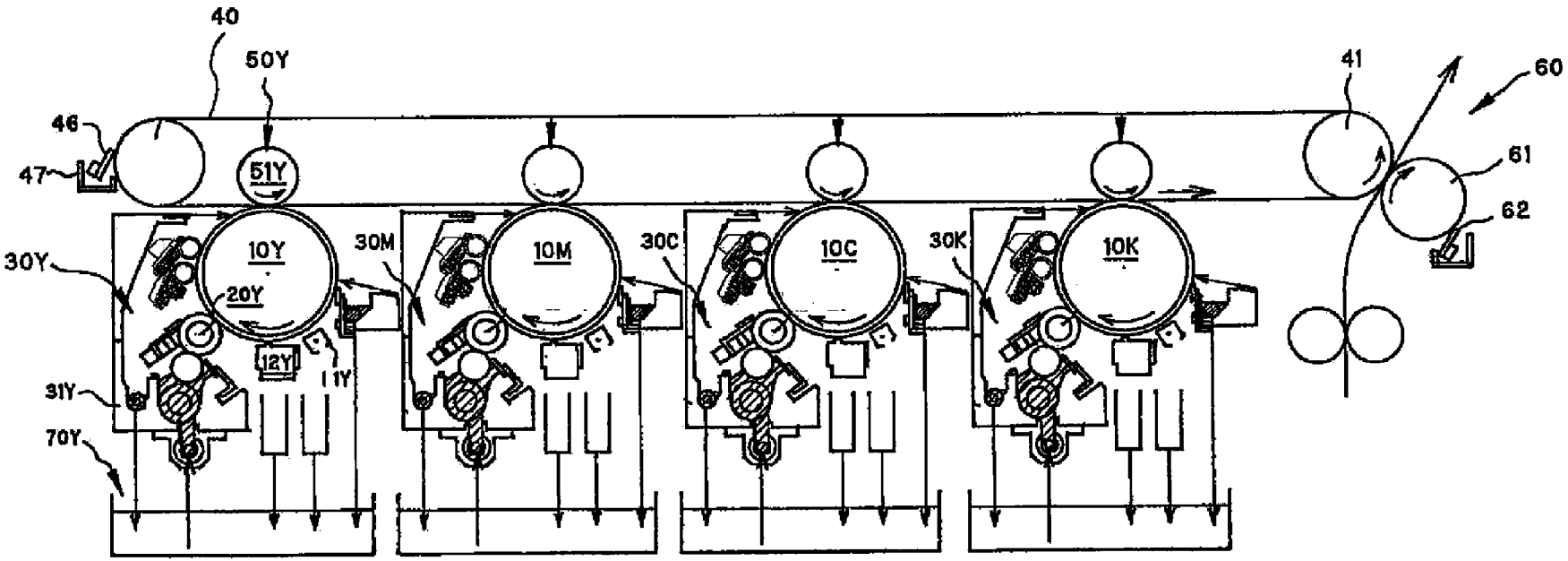
FIG. 1 is a schematic illustration of image forming apparatus according to an embodiment of the present invention.
Figure 2:
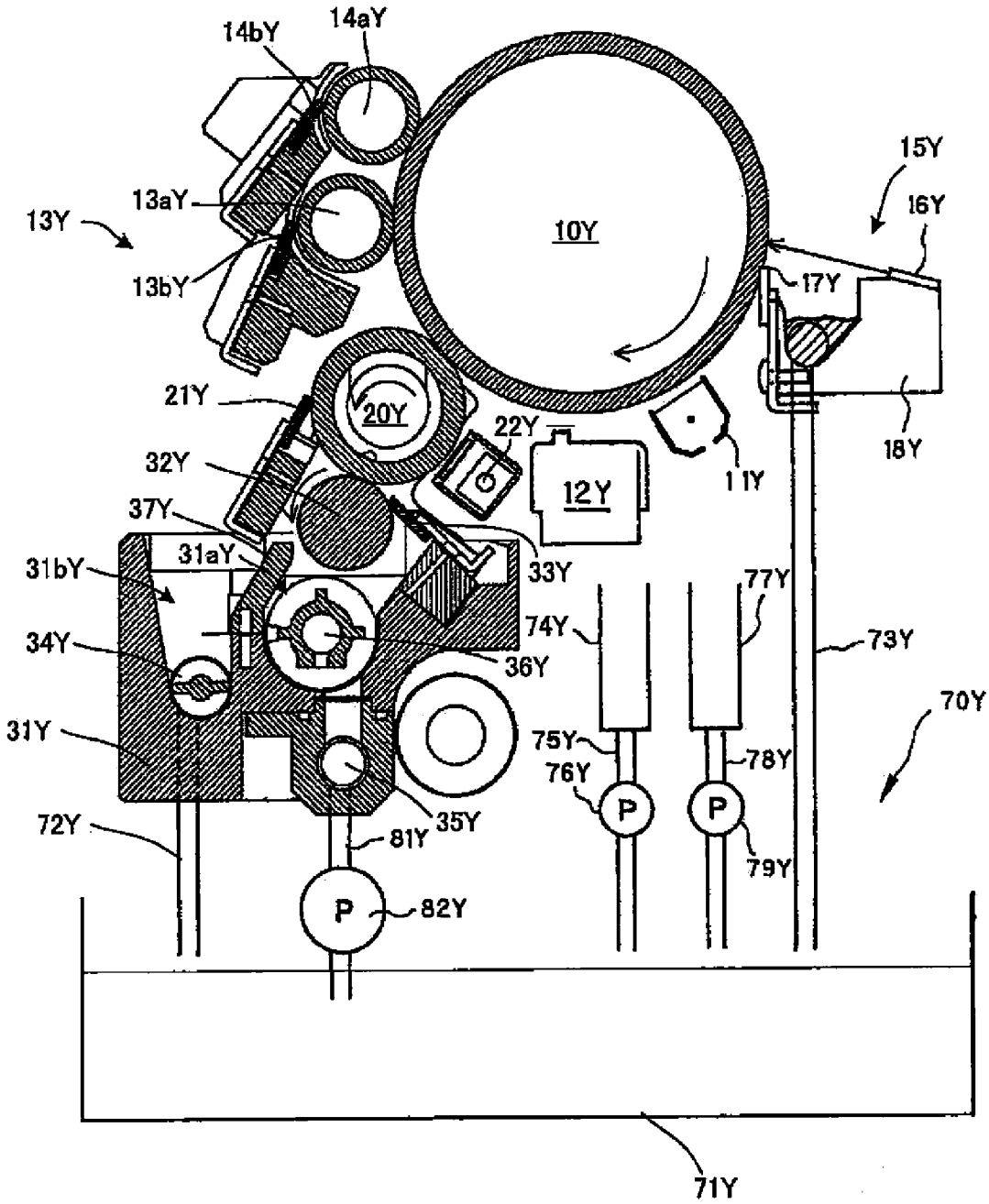
FIG. 2 is a schematic cross-sectional view of peripherals of a latent image carrier and principal components of a corresponding development unit of the embodiment.

Now, preferred embodiments of the present invention will be described by referring to the accompanying drawings. FIG. 1 is a schematic illustration of image forming apparatus according to an embodiment of the present invention, showing principal components thereof. FIG. 2 is a schematic cross-sectional view of peripherals of a latent image carrier 10Y and principal components of a corresponding development unit 30Y of the embodiment. In the following, only peripherals of the yellow (Y) latent image carrier 10Y and the yellow (Y) development unit 30Y will be described because the peripherals of all the latent image carrying bodies 10Y, 10M, 10C and 10K are structurally same and so are all the development units 30Y, 30M, 30C and 30K.

Referring to FIG. 2, the toner particles in the liquid developer contained in developer container 31Y have a positive electric charge and the liquid developer is agitated by agitation auger 36Y and sucked up from the developer container 31Y by a given quantity as developer supply roller 32Y, or a developer supply member, is driven to rotate.

The developer limiting blade 33Y is abut on the surface of the developer supply roller 32Y and scrapes off the excessive liquid developer from the surface, leaving the liquid developer in the grooves produced by the projections and the recesses of the anilox pattern formed on the surface of the developer supply roller 32Y so as to limit the quantity of liquid developer to be supplied to the development roller 20Y, or the developer carrier. With this limiting operation, the liquid developer that is applied to the development roller 20Y is quantified so as to make the film thickness of the liquid developer equal to about 6 μm. The liquid developer that is scraped off by the developer limiting blade 33Y is forced to drop back into the developer container 31Y by gravity, whereas the liquid developer that is not scraped off by the developer limiting blade 33Y and held in the grooves produced by the projections and the recesses on the surface of the developer supply roller 32Y is then applied to the surface of the development roller 20Y as it is pressed against the development roller 20Y.

The development roller 20Y to which liquid developer is applied by the developer supply roller 32Y faces a developer compression device 22Y at a position downstream relative to the nip section of the development roller 20Y and the developer supply roller 32Y. A bias voltage of about +400V is applied to the development roller 20Y, while a bias voltage that is higher than that of the development roller 20Y and shows a polarity same as the polarity of the electric charge of toner is applied to the developer compression device 22Y. For example, a bias voltage of about +4K is applied to the developer compression device 22Y.

The latent image carrier 10Y is made of amorphous silicon. After its surface is electrically charged to about +600V by electric charger 11Y at a position upstream relative to the nip section of the latent image carrier 10Y and the development roller 20Y, a latent image is formed thereon so as to make the image section thereof show an electric potential of +25 V by exposure unit 12Y. In the development nip section formed by the development roller 20Y and the latent image carrier 10Y, toner particles are selectively moved to the image section on the latent image carrier 10Y according to the electric field formed by the bias voltage of +400 V being applied to the developer 20Y and the latent image (image section: +25 V, non-image section +600 V) on the latent image carrier 10Y to consequently form a toner image on the latent image carrier 10Y. Since carrier liquid is not affected by the electrode field, it is divided at the exist of the development nip section of the development roller 20Y and the latent image carrier 10Y and adheres to both the development roller 20Y and the latent image carrier 10Y. After passing by the development nip section, the development roller 20Y is cleaned to get rid of liquid developer by development roller cleaning blade 21Y, or a developer carrier cleaning blade, and the removed liquid is collected.

After passing by the nip section, the latent image carrier 10Y then passes by squeezing roller 13Y. The squeezing roller 13Y has a function of collecting surplus carrier liquid and unnecessary fogging toner from the developer that is consumed for a development process on the latent image carrier 10Y to raise the content ratio of toner particles in the visible image. The capacity of collecting surplus carrier liquid can be set to a desired level by means of the sense of rotation of the first squeezing roller 13*a*Y and the second squeezing roller 14*a*Y and the relative peripheral speed difference between the peripheral speed of the surfaces of the first squeezing roller 13*a*Y and the second squeezing roller 14*a*Y relative to the peripheral speed of the surface of the latent image carrier 10Y. The collection capacity is raised by means of driving the squeezing rollers to rotate so as to counter the rotary motion of the latent image carrier 10Y or by means of raising the relative peripheral speed difference. The two means of raising the collection capacity may be combined to achieve a synergetic effect.

In this embodiment, the first squeezing roller 13*a*Y and the second squeezing roller 14*a*Y are typically driven to rotate at a substantially same peripheral speed relative to the latent image carrier 10Y to collect surplus carrier liquid from the developer consumed for a development process on the latent image carrier 10Y by about 5 to 10 wt % and suppress any external turbulence that can be exerted on the visible toner image on the latent image carrier 10Y.

Then, the latent image carrier 10Y passes by the nip section of itself and intermediate transfer belt 40 at primary transfer section 50Y to transfer the visible image on it to the intermediate transfer belt 40 in a primary transfer process. More specifically, the toner on the latent image carrier 10Y is transferred onto the intermediate transfer belt 40 for the primary transfer process as a voltage of about −200 V that shows a polarity opposite to the polarity of the electric charge characteristics of the toner particles is applied to the primary transfer roller 51Y so that only carrier liquid is left on the latent image carrier 10Y. Then, after the primary transfer process, the electrostatic latent image on the latent image carrier 10Y is erased by charge eliminator 16Y, which is typically formed by using an LED, at a position downstream relative to the primary transfer section in the sense of rotation of the latent image carrier 10Y and the carrier liquid left on the latent image carrier 10Y is scraped off by the latent image carrier cleaning blade 17Y and collected by development roller collection section 18Y.

The toner images formed on a plurality of latent image carrying bodies 10 are sequentially laid one on the other on the intermediate transfer belt 40 in a primary transfer process and the toner image on the intermediate transfer belt 40 proceeds to secondary transfer unit 60 and gets into the nip section of the intermediate transfer belt 40 and secondary transfer roller 61. The width of the nip section is defined to be equal to 3 mm. In the secondary transfer unit 60, a voltage of −1,200 V is applied to the secondary transfer roller 61 while a voltage of +200 V is applied to belt drive roller 41. Thus, as a result, the toner image on the intermediate transfer belt 40 is transferred onto a recording medium (sheet member), which is typically a sheet of paper.

However, when a sheet member feed trouble such as a jam takes place, the toner image may not entirely be transferred onto the secondary transfer roller but partly be left on the intermediate transfer belt. Additionally, the toner image on the intermediate transfer belt may not be transferred onto a sheet member by 100% in a secondary transfer process but may give rise to a secondary transfer residue of about several percent. Particularly, when a sheet member feed trouble such as a jam takes place, the toner image is brought into contact directly with the secondary transfer roller 61 and transferred onto the latter without a sheet member to consequently smear the rear surface of the sheet member that arrives thereafter.

For such an unneeded toner image, carrier liquid is collected (squeezed) to the side of the secondary transfer roller 61 of this embodiment and the surface of the intermediate transfer belt 40 is cleaned by intermediate transfer belt cleaning blade 46 and developer collection section 47 while the secondary transfer roller 61 is cleaned by secondary transfer roller cleaning blade 62.

The image forming method of the image forming apparatus of this embodiment includes a step where the developer supply roller 32Y sucks up liquid developer from supply section 31*a*Y in the developer container 31Y that stores liquid developer, a step where the developer supply roller 32Y supplies liquid developer to the development roller 20Y, a step where the electric charger 11Y electrically charges the latent image carrier 10Y, a step where the exposure device 12Y exposes the latent image carrier 10Y to light, a step where the development roller 20Y applies the liquid developer it carries to the latent image carrier 10Y, a step where the latent image carrier 10Y transfers the image it carries onto the intermediate transfer belt 40 and a step where the development roller cleaning blade 21Y cleans the surface of the development roller 20Y by removing the liquid developer on the development roller 20Y.

Now, the developer container 31Y and the developer collection/supply device 70Y of this embodiment will be described in detail below.

The developer collection/supply device 70Y has a liquid developer reservoir section 71Y for storing the collected liquid developer, supplying high concentration developer and carrier respectively from developer tank 74Y, which operates as supply section, and carrier liquid tank 77Y, which also operates as supply section, and regulating the concentration of developer.

The liquid developer contained in the liquid developer reservoir section 71Y is not a conventional popular volatile liquid developer that is a low concentration (1 to 2 wt %) and low viscosity liquid developer that is volatile at room temperature and formed by using Isopar (trademark: available from Exxon) as carrier liquid but a high concentration and high viscosity (about 30 to 10,000 mPa·s) nonvolatile liquid developer showing a toner solid concentration of about 25% and formed by adding a solid component prepared by dispersing a coloring agent such as a pigment into thermoplastic resin that is nonvolatile at room temperature into a liquid solvent such as organic solvent, silicon oil, mineral oil or edible oil with a dispersant.

In this embodiment, liquid developer is collected from the development unit 30Y and the latent image carrier 10Y.

The development unit 30Y includes a developer container 31Y for collecting and supplying liquid developer. The developer container 31Y has a supply section 31*a*Y and collection section 31*b*Y, of which the supply section 31*a*Y by turn has an agitation auger 36, which is an agitation member, for agitating the developer in the developer container 31Y and a communication section 35Y for supplying liquid developer to the agitation auger 36Y from the liquid developer reservoir section 71Y, which will be described in greater detail hereinafter, and the collection section 31*b*Y by turn has a collection auger 34Y having a helical blade that is a conveyance member for conveying the liquid developer scraped off by the development roller cleaning blade 21Y, the first squeezing roller cleaning blade 13*b*Y and the second squeezing roller cleaning blade 14*b*Y in a first direction X and feeding it to the liquid developer reservoir section 71Y.

The liquid developer that is collected to the side of the collection section 31*b*Y of the development unit 30Y is then collected into the liquid developer reservoir section 71Y by way of development unit collection channel 72Y that is a collection channel of the development device arranged at the side of one of the opposite ends of the collection auger 34Y. On the other hand, the liquid developer that is collected from the latent image carrier 10Y by the latent image carrier cleaning blade 15Y, which includes the latent image carrier cleaning blade 17Y and the developer collection section 18Y, is then also collected into the liquid developer reservoir section 71Y by way of latent image carrier collection channel 73Y.

Additionally, high concentration developer is supplied from the developer tank 74Y to the liquid developer reservoir section 71Y by way of developer supply channel 75Y and developer pump 76Y. On the other hand, carrier liquid is supplied from carrier liquid tank 77Y to the liquid developer reservoir section 71Y by way of carrier liquid supply channel 78Y and carrier liquid pump 79Y. A structure for supplying high concentration development roller and carrier liquid by opening and closing valves and utilizing gravity may be employed to replace the pumps and other components.

The liquid developer stored in the liquid developer reservoir section 71Y is then supplied to the developer container 31Y by way of developer supply channel 81Y, developer supply pump 82Y and the communication section 35Y.

Figure 3:
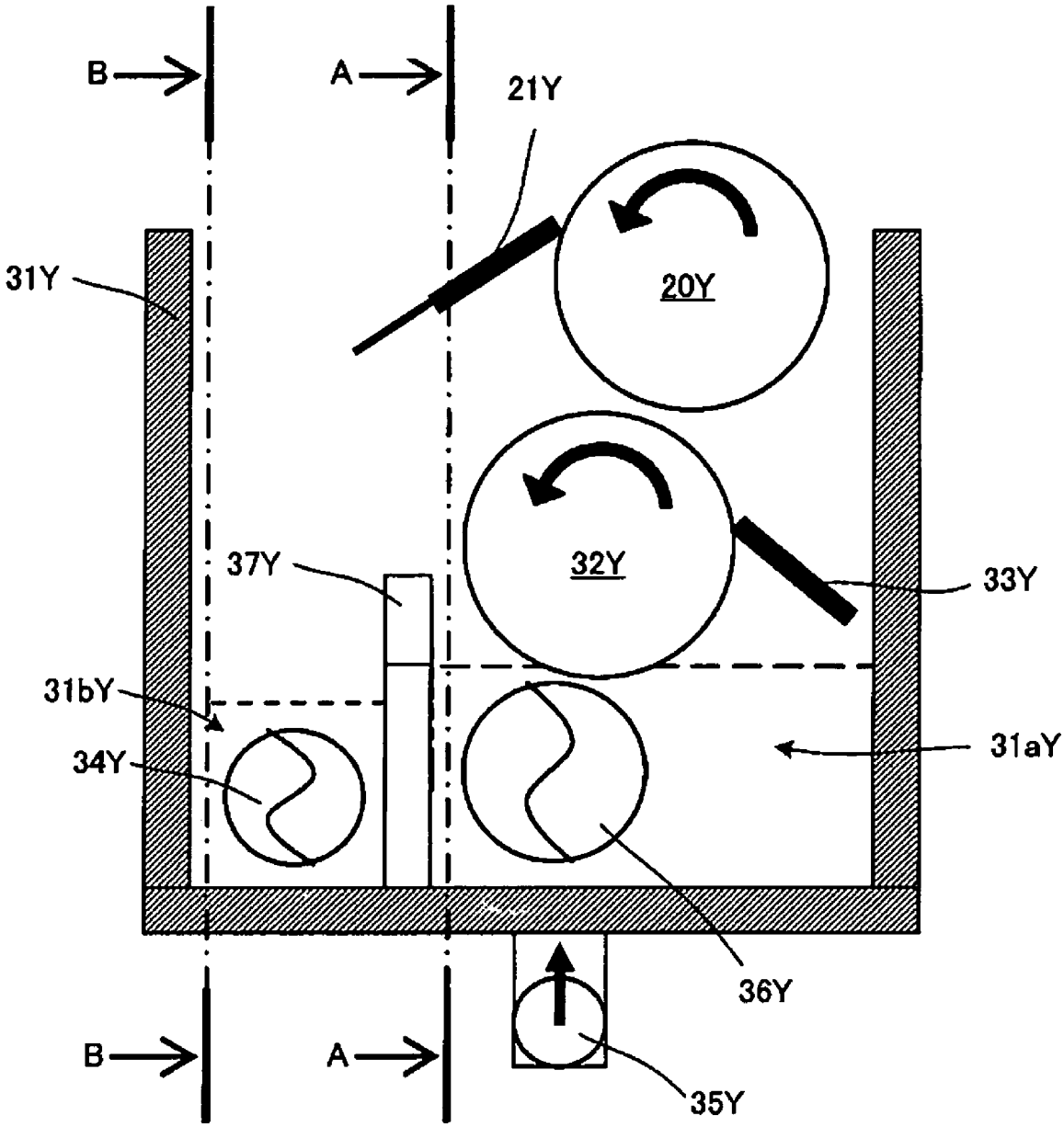
FIG. 3 is a schematic cross-sectional view of part of a development unit 30Y.
Figure 4:
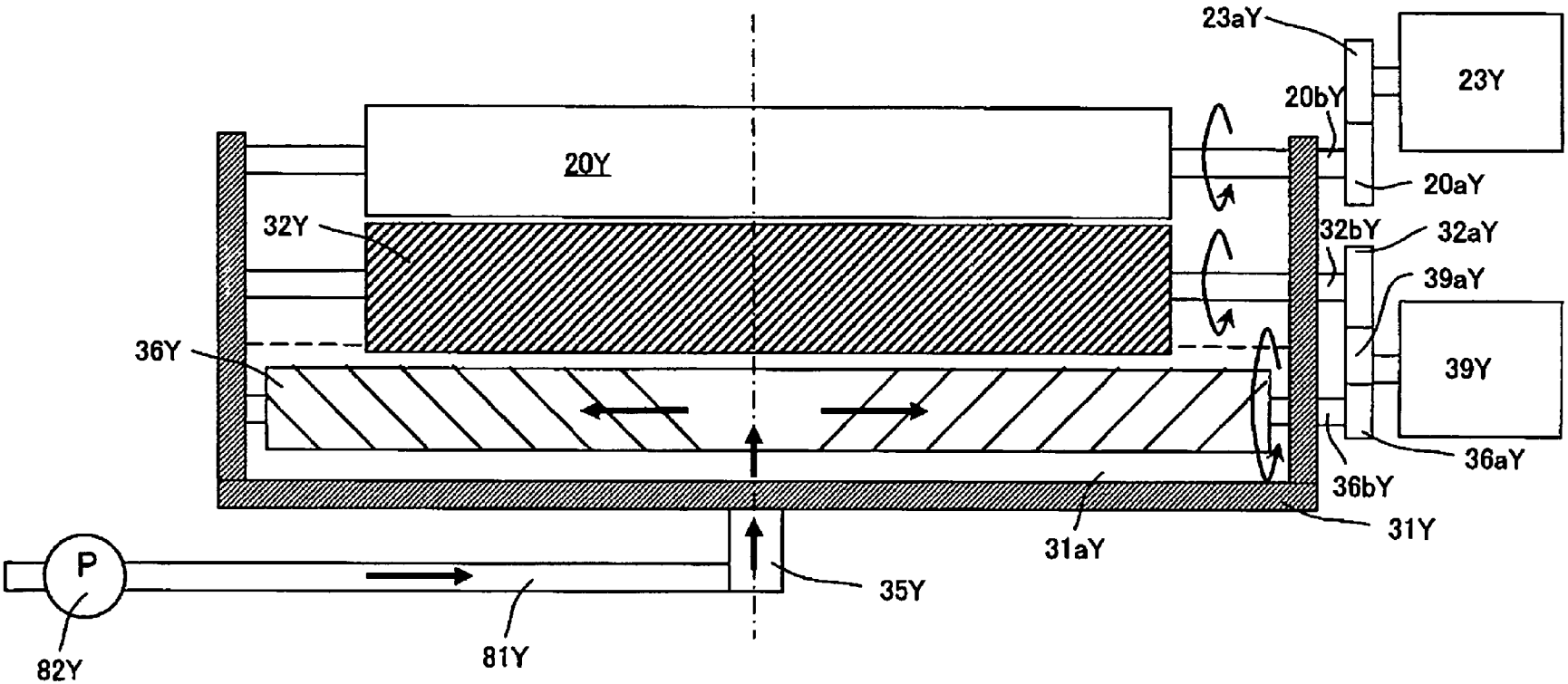
FIG. 4 is a schematic cross-sectional view of the development unit 30Y of FIG. 3 taken along plane A-A in FIG. 3 as viewed in the direction of the arrows A.
Figure 5:
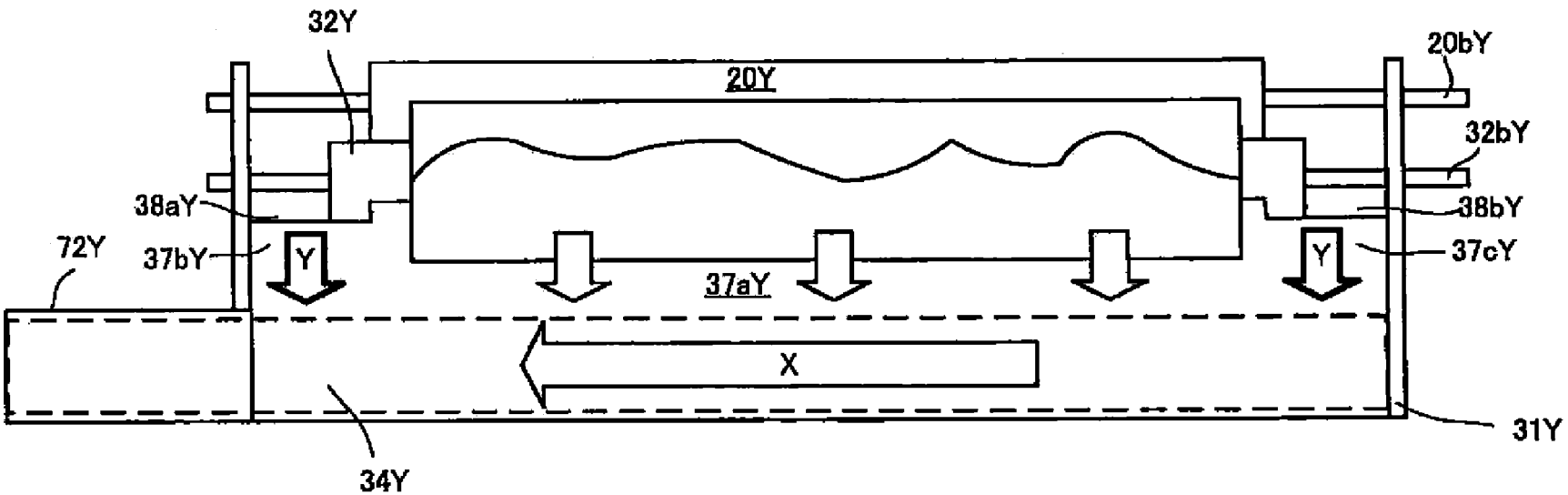
FIG. 5 is a schematic cross-sectional view of the development unit 30Y of FIG. 3 taken along plane B-B in FIG. 3 as viewed in the direction of arrows B.

Now, the flow of liquid developer in the developer container 31Y will be described below. FIG. 3 is a schematic cross-sectional view of part of a development unit 30Y. FIG. 4 is a schematic cross-sectional view of the development unit 30Y of FIG. 3 taken along plane A-A in FIG. 3 as viewed in the direction of the arrows A. FIG. 5 is a schematic cross-sectional view of the development unit 30Y of FIG. 3 taken along plane B-B in FIG. 3 as viewed in the direction of arrows B.

The developer container 31Y of this embodiment includes the supply section 31*a*Y and the collection section 31*b*Y, which are separated from each other by a liquid level regulation plate 37Y that is a partition section. The liquid level regulation plate 37Y is arranged in direction Y that is orthogonal or substantially orthogonal relative to the first direction X relative to the collection auger 34Y and includes a first flow section 38*a*Y and a second flow section 38*b*Y for flowing liquid developer from the supply section 31*a*Y. For instance, the liquid level regulation plate 37Y may be provided with a first wall height section 37*a*Y having a first wall height at a central part of the liquid level regulation plate 37Y, a first flow section 38*a*Y arranged above the first wall height section 37*a*Y at the side of the development unit collection channel 72Y to produce a second wall height section 37*b*Y that is lower than the center side of the first flow section 38*a*Y and a second flow section 38*b*Y arranged above the first wall height section 37*a*Y at the side opposite to the side of the development unit collection channel 72Y to produce a third wall height section 37*c*Y that is lower than the center side of the second flow section 38*b*Y.

Alternatively, the liquid level regulation plate 37Y may be made to have a same height all the way and provided with one or more holes at the side of the development roller collection channel 72Y as first flow section 38*a*Y and also with one or more holes at the side opposite to the side of the development unit collection channel 72Y as second flow section 38*b*Y. Still alternatively, a structure having a lower wall height relative to the center side of each flow section and a structure having holes may be combined.

Liquid developer is pumped up from the liquid developer reservoir section 71Y shown in FIG. 2 by the developer supply pump 82Y and supplies to the supply section 31*a*Y of the developer container 31Y by way of the developer supply channel 81Y and the communication section 35Y. As shown in FIG. 4, the communication section 35Y is arranged substantially at the axial center of the supply section 31*a*Y and the liquid developer supplied to the supply section 31*a*Y spreads from a substantially axial center part toward the opposite ends of the supply section 31*a*Y by the rotation of the agitation auger 36Y.

As the quantity of liquid developer in the supply section 31*a*Y increases, liquid developer overflows from the first flow section 38*a*Y and the second flow section 38*b*Y arranged at the opposite ends of the liquid level regulation plate 37Y into the collection section 31*b*Y as shown in FIG. 5. In the collection section 31*b*Y, liquid developer is conveyed into the development roller collection channel 72Y by the rotation of the collection auger 34Y so as to be collected in the liquid developer reservoir section 71Y by way of the development roller collection channel 72Y.

Note that, as shown in FIG. 4, the development roller 20Y is driven to rotate with the development roller gear 20*a*Y and the development roller shaft 20*b*Y by development roller drive motor 23Y by way of development roller drive motor gear 23*a*Y. The developer supply roller 32Y and the agitation auger 36Y are driven to rotate respectively with developer supply roller motor gear 32*a*Y and developer supply roller shaft 32*b*Y and with agitation auger gear 36*a*Y and agitation auger shaft 36*b*Y by developer supply section motor 39Y, which is a common developer supply section drive source, by way of developer supply section motor gear 39*a*Y. The collection auger 34Y is driven to rotate with a collection auger gear and a collection auger shaft by a developer collection section motor 39*c*Y (FIG. 9), which is a developer collection section drive source (not shown).

The liquid developer that flows from the first flow section 38*a*Y and the second flow section 38*b*Y of the liquid level regulation plate 37Y, the liquid developer that flows from other part or parts of the liquid level regulation plate 37Y and the liquid developer that is collected from the development roller cleaning blade 21Y are agitated by the collection auger 34Y as they are being conveyed. Therefore, the length of agitation is increased to improve the effect of agitation and dispersion when the second flow section 38*b*Y is arranged at the upstream side that is opposite to the side of the development roller collection channel 72Y. Then, those parts of liquid developer can readily be mixed with liquid developer showing a different concentration when they are collected into the liquid developer reservoir section 71Y.

Figure 6:
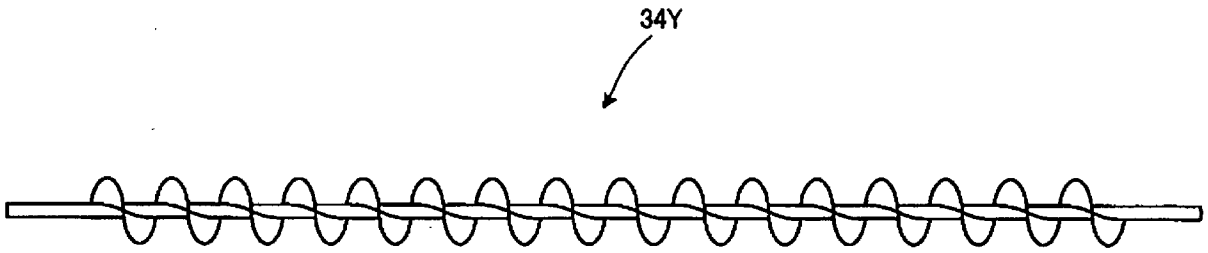
FIG. 6 is a schematic illustration of a collection auger that can be used for the purpose of the present invention.

FIG. 6 is a schematic illustration of a collection auger 34Y that can be used for this embodiment. The collection auger 34Y conveys liquid developer and is provided with a helical blade as shown in FIG. 6. The helical blade is a liquid developer conveying part that improves the effect of agitation and dispersion.

Figure 7:
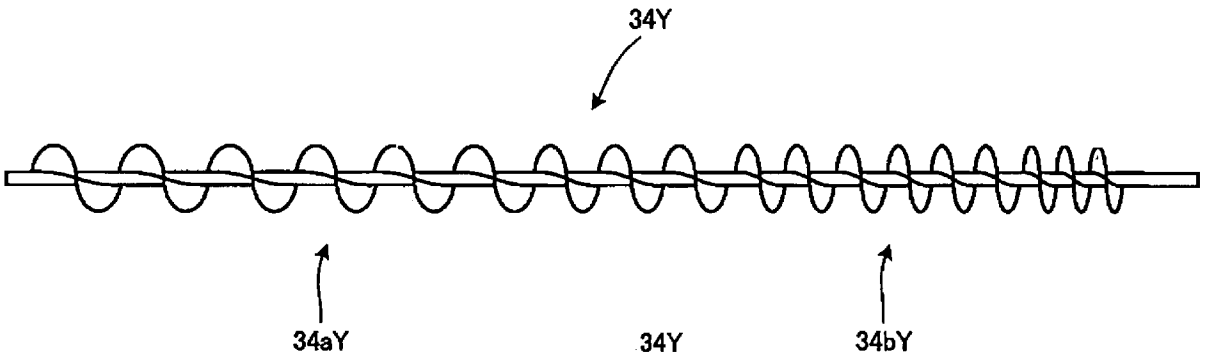
FIG. 7 is a schematic illustration of another collection auger that can be used for the purpose of the present invention.

FIG. 7 is a schematic illustration of another collection auger 34Y that can be used for this embodiment. The collection auger 34Y includes parts showing respective pitches that are different from each other. In other word, the pitch is gradually increased toward the development roller collection channel 72Y as shown in FIG. 7. As the helical blade is made to show different pitches, the rate of conveyance of liquid developer is differentiated to improve the effect of agitation.

Figure 8:
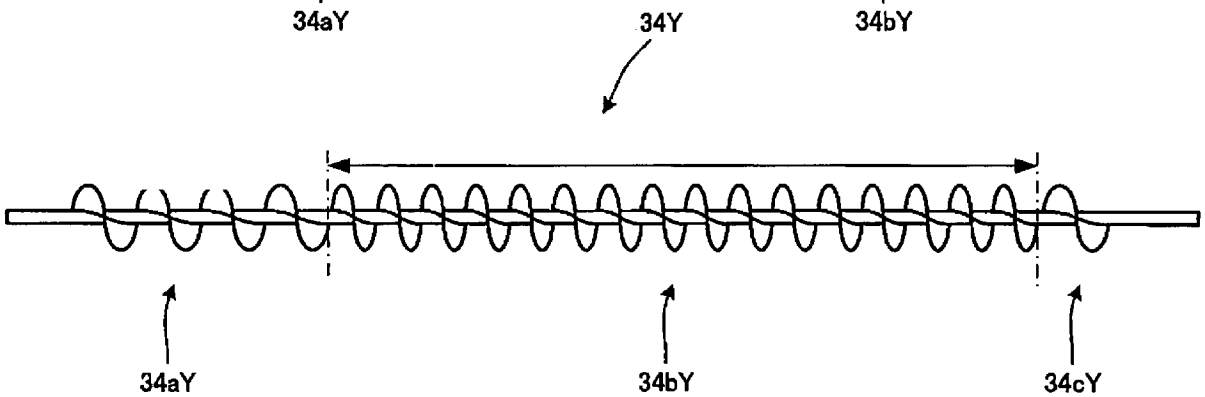
FIG. 8 is a schematic illustration of still another collection auger that can be used for the purpose of the present invention.

FIG. 8 is a schematic illustration of still another collection auger 34Y that can be used for this embodiment. The collection auger 34Y of FIG. 8 has a first conveyance pitch section 34*a*Y, or a first conveyance section, arranged at a position that is lower than and corresponds to the first flow section 38*a*Y, a second conveyance pitch section 34*b*Y, or a second conveyance section, arranged at the upstream side opposite to the side of the development roller collection channel 72 and showing a pitch smaller than the first conveyance pitch section 34*a*Y and a third conveyance pitch section 34*c*Y, or a third conveyance section, arranged at a position that is lower than and corresponds to the second flow section 38*b*Y.

With the above-described arrangement, the quantity by which liquid developer is conveyed per unit length of the second conveyance pitch section 34*b*Y is smaller than the corresponding quantity by which liquid developer is conveyed per unit length of the first conveyance pitch section 34*a*Y and hence the quantity of liquid developer that is conveyed from the first conveyance pitch section 34*a*Y to the development unit collection channel 72Y per unit time is greater than the quantity of liquid developer that is conveyed from the second conveyance pitch section 34*b*Y to the first conveyance pitch section 34*a*Y per unit time so that liquid developer stays to a lesser extent below the first flow section 38*a*Y.

The quantity of liquid developer that is conveyed per unit length of the third conveyance pitch section 34*c*Y is greater than the quantity of liquid developer that is conveyed per unit length of the second conveyance pitch section 34*b*Y and hence the quantity of liquid developer that is conveyed from the third conveyance pitch section 34*c*Y to the second conveyance pitch section 34*b*Y per unit time is smaller than the quantity of liquid developer that is conveyed from the second conveyance pitch section 34*b*Y to the first conveyance pitch section 34*a*Y per unit time so that liquid developer can be made to stay to a lesser extent below the second flow section 38*b*Y but there arises a risk that liquid developer stays in the second conveyance pitch section 34*b*Y.

However, since the rate at which liquid developer flows from the central side first wall height section 37*a*Y is smaller than the rate at which liquid developer flows from the first flow section 38*a*Y and the second flow section 38*b*Y, the liquid developer in the collection section 31*b*Y is made even in the first direction as a whole to show a well balanced condition.

Note that the second conveyance pitch section 34*b*Y of the collection auger 34Y shown in FIG. 8 may be so modified that it shows a pitch that gradually decreases toward the upstream side that is opposite to the side of the development roller collection channel 72Y so as to gradually decrease the conveyance rate.

While the second conveyance pitch section 34*b*Y of the collection auger 34Y shown in FIG. 8 is arranged at a position that corresponds to the first wall height section 37*a*Y, it may alternatively be arranged at a position that corresponds to the development roller cleaning blade 21Y. Then, the second conveyance pitch section 34*b*Y may be made to show a pitch that gradually decreases toward the upstream side that is opposite to the side of the development roller collection channel 72Y so as to gradually decrease the conveyance rate.

Now, the operation of controlling the rate of conveyance of liquid developer will be described below. In this embodiment, the rotational speed of the collection auger 34Y and the rate of conveyance of liquid developer are controlled according to image information.

Figure 9:
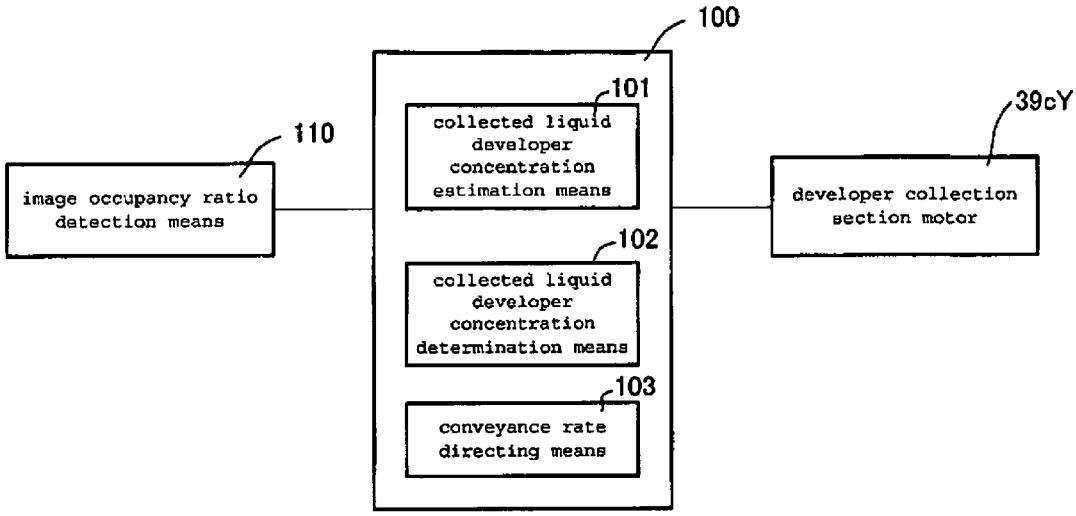
FIG. 9 is a schematic block diagram of a liquid developer conveyance rate control device.

FIG. 9 is a schematic block diagram of liquid developer conveyance rate control device 100. The conveyance rate control device 100 includes a collected liquid developer concentration estimation means 101, a collected liquid developer concentration determination means 102 and a conveyance rate directing means 103 and is adapted to control the rotational speed of the collection auger 34Y by processing the input signal from image occupancy ratio detection means 110 that is an image information detection means and controlling the number of revolutions per unit time of the developer collection motor 39*c*Y, which is a speed shifting means.

In this embodiment, the image occupancy ratio is utilized as image information. The image occupancy ratio is the number of dots to be printed relative to the total number of dots contained in a page of recording medium (the total of the number of dots to be printed and the number of dots not to be printed). It is detected by way of an arithmetic operation conducted on image data by the image occupancy ratio detection means 110.

Figure 10:
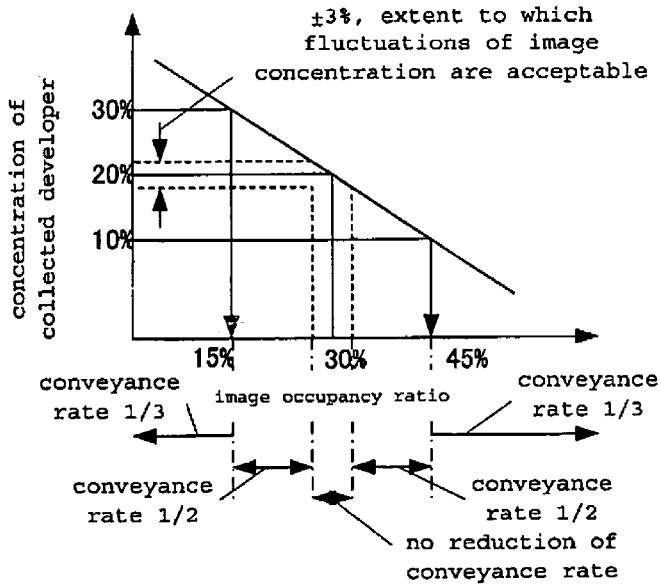
FIG. 10 is a graph illustrating the relationship between the image occupancy ratio and the concentration of the liquid developer collected by a development roller cleaning blade.

The collected liquid developer concentration estimation means 101 estimates the concentration of the liquid developer that the development roller cleaning blade 21Y collected from the image occupancy ratio that is detected by the image occupancy ratio detection means 101 by referring to a prediction table as shown in FIG. 10.

The collected liquid developer concentration determination means 102 determines the range of concentration in which the concentration of liquid developer estimated by the collected liquid developer concentration estimation means 101 is found.

The conveyance rate directing means 103 determines the rotational speed of the collection auger 34Y according to the concentration of the liquid developer collected by the development roller cleaning blade 21Y as determined by the collected liquid developer concentration determination means 102.

Figure 11:
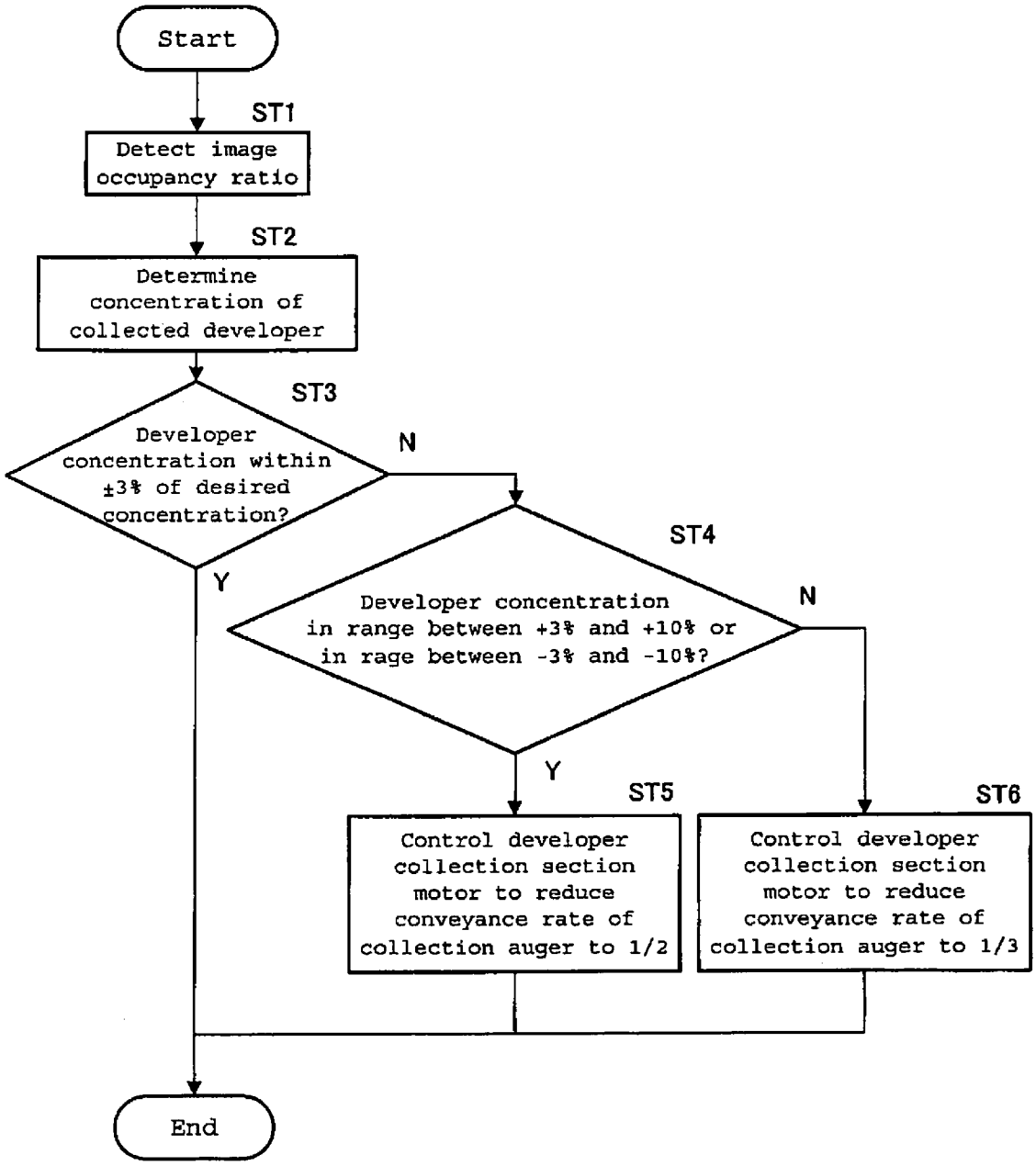
FIG. 11 is a flowchart of the first example of control of the conveyance rate of liquid developer by a liquid developer conveyance rate control device.

FIG. 11 is a flowchart of the first example of control of the conveyance rate of liquid developer by the conveyance rate control device 100. The control process of this example includes a step where the image occupancy ratio is detected, a step where the concentration of the liquid developer collected in the collection section 31*b*Y of the developer container 31Y by the development roller cleaning blade is determined for the detected image occupancy ratio and a step where the conveyance rate of the collection auger 34Y conveying liquid developer from the collection section 31*b*Y is controlled according to the determined concentration. This control process will be described more specifically below.

Firstly, in Step 1, the image occupancy ratio detection means 110 detects the image occupancy ratio (ST1). Then, in Step 2, the collected liquid developer concentration determination means 102 determines the concentration of the liquid developer collected by the development roller cleaning blade 21Y (ST2).

Thereafter, in Step 3, the collected liquid developer concentration determination means 102 determines if the concentration of the liquid developer is within ±3% of the desired concentration of liquid developer or not (ST3). If it is determined in Step 3 that the determined concentration of the liquid developer is within ±3% of the desired concentration of liquid developer, the conveyance rate directing means 103 does not shift the rotational speed of the collection auger 34Y and ends the conveyance rate control process. If, on the other hand, the determined concentration of the liquid developer is out of ±3% of the desired concentration of liquid developer, the collected liquid developer concentration determination means 102 then determines if the determined concentration of the liquid developer is within the range between +3% and +10% or between −3% and −10% of the desired concentration of liquid developer or not (ST4).

If it is determined in Step 4 that the determined concentration of the liquid developer is within the range between +3% and +10% or within the range between −3% and −10% of the desired concentration of liquid developer, the conveyance rate directing means 103 reduces the number of revolutions per unit time of the developer collection section motor 39*c*Y in Step 5 so as to reduce the rotational speed of the collection auger 34Y to ½ of the current rotational speed (ST5) and ends the conveyance rate control process. If, on the other hand, it is determined in Step 4 that the determined concentration of the liquid developer is out of the range between +3% and +10% and the range between −3% and −10% of the desired concentration of liquid developer and hence either above +10% or below −10%, the conveyance rate directing means 103 reduces the number of revolutions per unit time of the development roller collection section motor 39*c*Y in Step 6 so as to reduce the rotational speed of the collection auger 34Y to ⅓ of the current rotational speed (ST6) and ends the conveyance rate control process.

Figure 12:
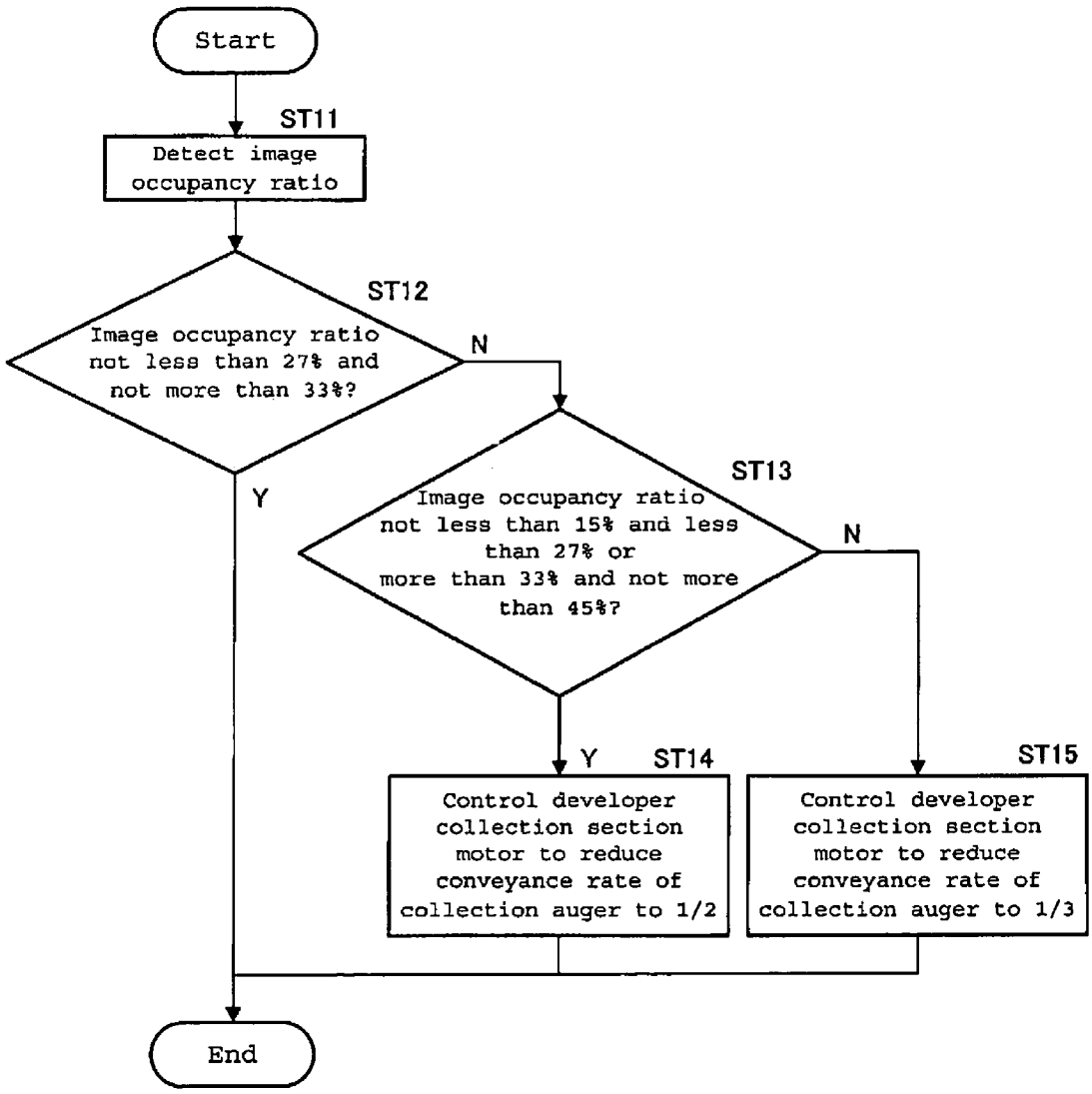
FIG. 12 is a flowchart of the second example of control of the conveyance rate of liquid developer by a liquid developer conveyance rate control device.

FIG. 12 is a flowchart of the second example of control of the conveyance rate of liquid developer by the conveyance rate control device 100. The control process of this example includes a step where the image occupancy ratio is detected, a step where the liquid developer concentration estimation means estimates the concentration of the liquid developer collected in the collection section 31*b*Y of the developer container 31Y by the development roller cleaning blade 21Y for the detected image occupancy ratio and a step where the conveyance rate of the collection auger 34Y conveying liquid developer from the collection section 31*b*Y is controlled according to the outcome of detection of the image occupancy ratio that corresponds to the estimated concentration. This control process will be described more specifically below.

In this embodiment, that the estimated concentration of the liquid developer is within ±3% of the desired concentration of liquid developer corresponds to that the image occupancy ratio is not less than 27% and not more than 33%. Additionally, that the estimated concentration of the liquid developer is within the range between +3% and +10% or within the range between −3% and −10% of the desired concentration of liquid developer corresponds to that the image occupancy ratio is within the range between not less than 15% and less than 27% or within the range between more than 33% and not more than 45%. Additionally, a case where the estimated concentration of the liquid developer is neither within the range between +3% and +10% nor within the range between −3% and −10% and hence exceeds +10% or falls below −10% corresponds to a case where the image occupancy ratio is less than 15% or exceeds 45%.

Firstly, in Step 11, the image occupancy ratio detection means 110 detects the image occupancy ratio (ST11) . Then, in Step 12, the collected liquid developer concentration determination means 102 determines if the image occupancy ratio is within the range between not less than 27% and not more than 33% or not (ST12). If it is determined in Step 12 that the image occupancy ratio is within the range between not less than 27% and the more than 33%, the conveyance rate directing means 103 ends the conveyance rate control process without shifting the rotational speed of the collection auger 34Y. If, on the other hand, it is determined in Step 12 that the image occupancy ratio is not within the range between not less than 27% and the more than 33%, the collected liquid developer concentration determination means 102 determines in Step 13 if the image occupancy ratio is within either of the range between not less than 15% and less than 27% and the range exceeding 33% and not less than 45% or not (ST13).

If it is determined in Step 13 that the image occupancy ratio is within either of the range between not less than 15% and less than 27% and the range exceeding 33% and not less than 45%, the conveyance rate directing means 103 reduces the number of revolutions per unit time of the developer collection section motor 39*c*Y in Step 14 so as to reduce the rotational speed of the collection auger 34Y to ½ of the current rotational speed (ST14) and ends the conveyance rate control process. If, on the other hand, it is determined in Step 13 that the image occupancy ratio is out of the range between not less than 15% and less than 27% and the range exceeding. 33% and not less than 45%, the conveyance rate directing means 103 reduces the number of revolutions per unit time of the development roller collection section motor 39*c*Y in Step 15 so as to reduce the rotational speed of the collection auger 34Y to ⅓ of the current rotational speed (ST15) and ends the conveyance rate control process.

Thus, since the development unit 30Y of this embodiment includes the development roller 20Y that carries liquid developer, a developer supply roller 32Y that supplies liquid developer to the development roller 20Y, the development roller cleaning blade 21Y that collects the liquid developer on the development roller 20Y, the collection section 31*b*Y that collects the liquid developer collected by the development roller cleaning blade 21Y, the supply section 31*a*Y that flows liquid developer into the collection section 31*b*Y, the conveyance member 34Y that conveys liquid developer from the collection section 31*b*Y in the first direction X and the developer collection section motor 39cY that can shift the rate of conveyance of the conveyance member 34Y as described above, it is now possible to improve the effect of agitation dispersion of the liquid developer in the developer container 31Y without requiring addition of one or more members and/or any significant modification of the configuration.

Similarly, since the image forming apparatus of this embodiment includes the above-described development unit 30Y, the developer collection section motor 39*c*Y that can shift the rate of conveyance of the conveyance member 34Y, the latent image carrier 10Y on which the latent image it carries is developed by the development roller 20Y, the electric charger 11Y that electrically charges the latent image carrier 10Y, the exposure device 12Y that exposes the latent image carrier 10Y to light, the transfer member 40 that transfers the image on the latent image carrier 10Y, the image information detection means 110 that detects image information, the liquid developer concentration determination means 102 that determines the concentration of the liquid developer collected by the development roller cleaning blade 21Y for the outcome of detection of the image information detection means 110 and the conveyance rate directing means 103 that directs the developer collection section motor 39*c*Y to shift the rate of conveyance of the conveyance member 34Y according to the concentration determined by the liquid developer concentration determination means 102 as described above, it is now possible to provide an image forming apparatus that can produce high-quality images at low cost and improve the effect of agitation and dispersion of the liquid developer in the developer container 31Y without requiring addition of one or more members and/or any significant modification of the configuration.

Furthermore, since the image forming apparatus of this embodiment includes the above-described development device 30Y, the developer collection section motor 39*c*Y that can shift the rate of conveyance of the conveyance member 34Y, the latent image carrier 10Y on which the latent image it carries is developed by the development roller 20Y, the electric charger 11Y that electrically charges the latent image carrier 10Y, the exposure device 12Y that exposes the latent image carrier 10Y to light, the transfer member 40 that transfers the image on the latent image carrier 10Y, the image information detection means 110 that detects image information, the liquid developer concentration estimation means 101 that estimates the concentration of the liquid developer collected by the development roller cleaning blade 21Y in advance for the outcome of detection of the image information detection means 110 and the conveyance rate directing means 103 that directs the developer collection section motor 39*c*Y to shift the rate of conveyance of the conveyance member 34Y according to the outcome of detection of the image information detection means 110 that corresponds to the concentration estimated by the liquid developer concentration estimation means 101 as described above, it is now possible to provide an image forming apparatus that can produce high-quality images at low cost and improve the effect of agitation and dispersion of the liquid developer in the developer container 31Y without requiring addition of one or more members and/or any significant modification of the configuration.

Additionally, since the image information detection means 110 detects the image occupancy ratio by determining the number of dots to be printed relative to the total number of dots contained in a page of recording medium, or a transfer medium, it is now possible to provide an image forming apparatus that can produce high-quality images at low cost.

Still additionally, since the development device of this embodiment includes the development device collection channel 72Y for collecting liquid developer at the side of one of the opposite ends of the conveyance member 34Y and the partition section 37Y arranged between the supply section 31*a*Y and the collection section 31*b*Y and the partition section 37Y by turn includes the first wall height section 37*a*Y, the second wall height section 37*b*Y arranged at the side of the first direction X relative to the first wall height section 37*a*Y, the third wall height section 37*c*Y arranged at the side opposite to the side of the first direction X relative to the first wall height section 37*a*Y and the second wall height section 37*b*Y, the first flow section 38*a*Y arranged in the direction of the second direction Y that is orthogonal or substantially orthogonal to the first direction X relative to the conveyance member 34Y so as to flow liquid developer from the supply section 31*a*Y and the second flow section 38*b*Y arranged in the second direction Y that is orthogonal or substantially orthogonal to the first direction X relative to the conveyance member 34Y in the second wall height section 37*b*Y so as to flow liquid developer from the supply section 31*a*Y, it is now possible to reduce the leakage of liquid from the developer container 31Y.

Still additionally, since the conveyance member 34Y has the collection auger 34Y having a helical blade, it is now possible to convey liquid developer in well balanced manner with a simple structure.

Now, another embodiment of the present invention will be described in greater detail.

Liquid developer is conveyed to the supply section 31*a*Y of this embodiment from the liquid reservoir section 71Y at a rate of about 60 cc/min, of which about 30 cc/min is applied to the development roller 20Y to produce a desired developer film thickness (about 6.5 μm in this embodiment) by way of the developer supply roller 32Y. The balance of about 30 cc/min overflows the liquid level regulation plate 37Y and flows into the collection section 31*b*Y. Of the about 30 cc/min that is applied to the development roller 20Y, about 15 cc/min is scraped off as residual liquid developer by the cleaning operation of the development roller cleaning blade 21Y although the value depends on the image occupancy ratio. Thus, liquid developer is collected at a rate of about 45 cc/min including the liquid developer overflowing the liquid level regulation plate 37Y and the liquid developer scraped off by the cleaning operation of the development roller cleaning blade 21Y, of which about 15 cc/min is agglomerated toner solid.

The state of agglomeration of the agglomerated toner solid is degraded by the developer compression device 22Y as shown in FIG. 2. Since the compressed state of toner solid varies according to the characteristics of liquid developer, the operator inputs agglomeration characteristics of the liquid developer or the post-development agglomeration characteristics are transferred from an IC memory annexed to the developer container 31Y to update the reference rate of the conveyance rate control device 100. The reference rate is predetermined and provides a reference rate for the conveyance rate.

Figure 13:
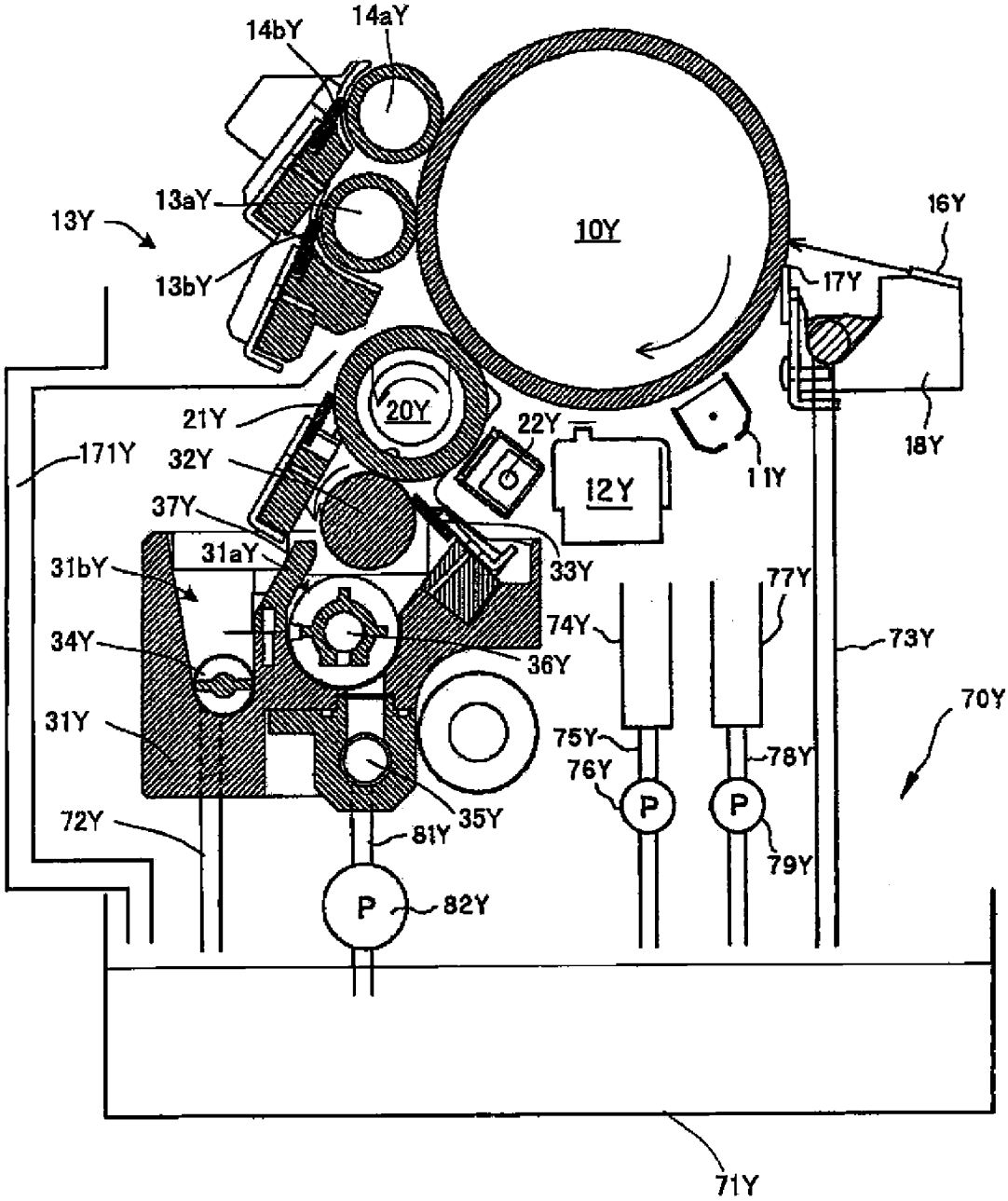
FIG. 13 is a schematic cross-sectional view of peripherals of a latent image carrier and principal components of a corresponding development unit of image forming apparatus according to another embodiment of the present invention.

A squeezing roller collection channel 171Y for colleting the liquid developer that is collected by the first squeezing roller 13*a*Y or the second squeezing roller 14*a*Y may be arranged as shown in FIG. 13. The squeezing roller collection channel 171Y is provided with a conveyance auger (not shown) that can drive liquid developer in the axial direction of the roller and the collected liquid developer is then collected in the liquid developer reservoir section 71Y.

The image occupancy ratio that is utilized as image information may be so defined as to be used for the arithmetic operation to be conducted for each printing job or every 100 sheets of printing medium. Particularly, when the volume of printing medium that is consumed for printing at a time is large, the conveyance rate is preferably controlled for every 100 sheets because it cannot be controlled for each printing job.

The conveyance rate may be controlled by means of a pulse control technique, keeping the number of revolutions per unit time of the collection auger 34 to a constant value. For example, if it is determined in Step 13 that the image occupancy ratio is found within the range between not less than 15% and less than 27% or within the range between more than 33% and not more than 45%, the developer collection section motor 39*c*Y is so controlled as to keep the rotational duty thereof to 50% in Step 14 (ST14). If, on the other hand, it is determined in Step 13 that the image occupancy ratio is found to be out of the range between not less than 15% and less than 27% and the range exceeding 33% and not less than 45% and hence the image occupancy ratio is less than 15% or exceeds 45%, it may be so arranged that the conveyance rate directing means 103 controls the developer collection section motor 39*c*Y so as to keep the rotational duty thereof to 30% in Step 15 (ST15).

Figure 14:
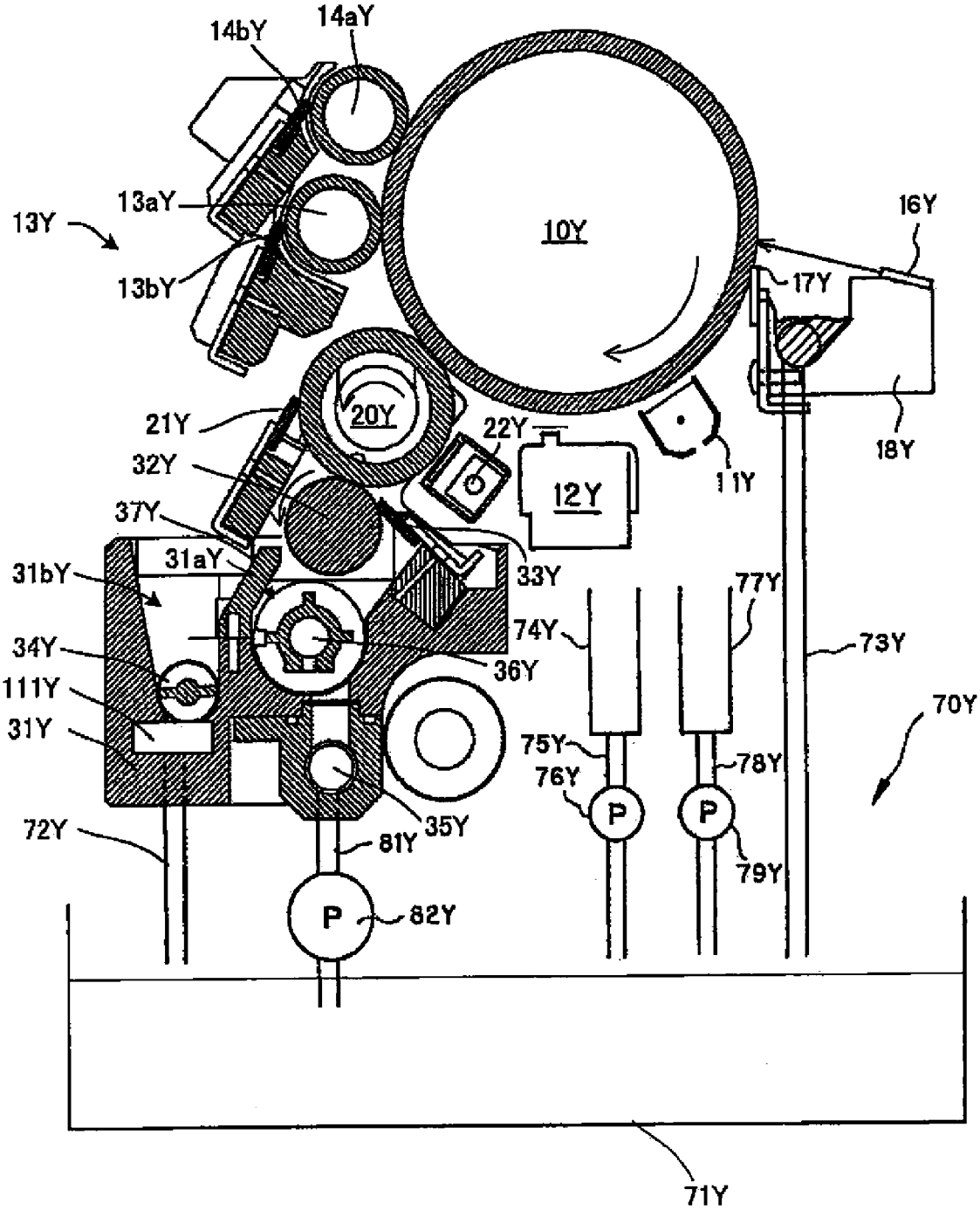
FIG. 14 is a schematic cross-sectional view of peripherals of a latent image carrier and principal components of a corresponding development unit of image forming apparatus according to still another embodiment of the present invention.

Additionally, a concentration sensor 111Y may be arranged as input means for the collection section 31*b*Y as shown in FIG. 14 so as to control the rate of conveyance of liquid developer according to the concentration value of the collected liquid developer as determined by the liquid developer concentration determination means.

For example, the collection auger 34Y may be so temporally controlled as to be driven to rotate intermittently according to the concentration value detected by the concentration sensor 111Y. More specifically, if it is determined in Step 13 that the image occupancy ratio is found within the range between not less than 15% and less than 27% or within the range between more than 33% and not more than 45%, the developer collection section motor 39*c*Y is so controlled in Step 14 as to be driven to rotate for ½ of the time of operation of the embodiment (ST14). If, on the other hand, it is determined in Step 13 that the image occupancy ratio is found to be out of the range between not less than 15% and less than 27% and the range exceeding 33% and not less than 45% and hence the image occupancy ratio is less than 15% or exceeds 45%, the developer collection section motor 39*c*Y may be so controlled in Step 15 as to be driven to rotate for ⅓ of the time of operation of the embodiment (ST15).

With the above-described arrangement, the concentration may be detected by measuring the propagation time of sound wave in the liquid developer by means of an ultrasonic sensor or by measuring the quantity of light transmitted through the liquid developer. The concentration sensor 111Y may be arranged at a position most downstream in the direction of conveyance of the collection section 31*b*Y so as to measure the concentration of the agitated liquid developer. Then, the embodiment may be relieved from falling into hypersensitiveness in controlling the conveyance rate. In other words, the embodiment can mildly control the conveyance rate without modifying it too frequently.

Note that the flowchart of FIG. 11 is applicable to pulse control and intermittent drive control.

For the computation of the image occupancy ratio, not the surface area of a page of recording paper, or a transfer medium, but the quantity of toner that is made to adhere to the photosensitive body 10Y for a page of recording medium is preferably used as denominator. In other words, the quantity of toner that is consumed in the printing intervals in a continuous printing operation or the area including the printing margins is preferably used as denominator. If solid images are printed continuously on entire sheets of recording paper, the image occupancy ratio does not get to 100% because no image is printed in the printing intervals and on the transversal margins. If an image pattern is printed in one or more of the printing intervals to read the image concentration, such a pattern is also included in the image area.

Figure 15:
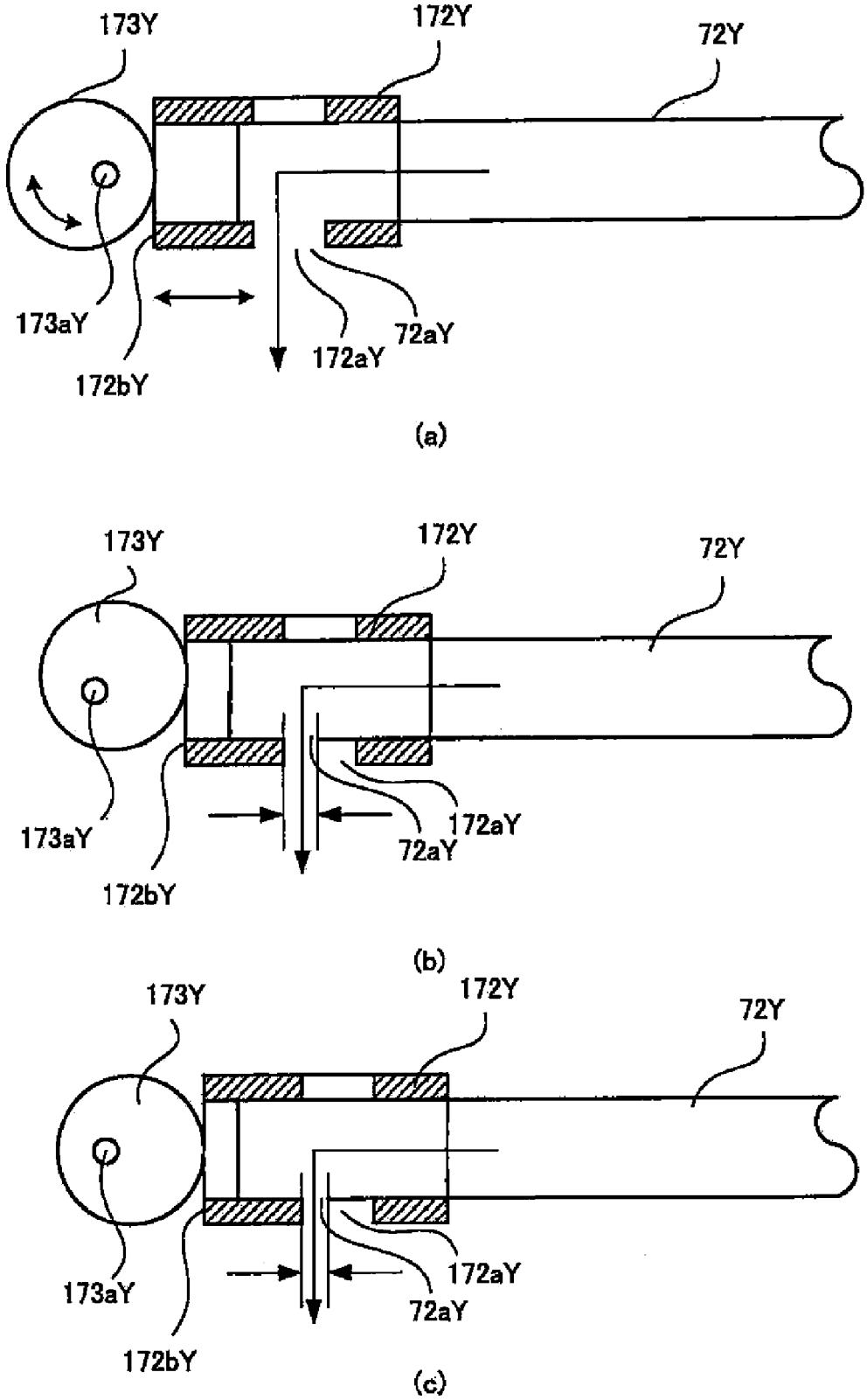
FIGS. 15A through 15C are schematic illustrations of a possible structure of development unit collection channel 72Y.

Now, a specific exemplary arrangement at and near the exit of the development unit collection channel 72Y will be described below. FIGS. 15A through 15C are schematic illustrations of a possible structure of development unit collection channel 72Y. FIG. 15A shows the aperture of the exit that is fully opened, or by 100%. FIG. 15B shows the aperture of the exit that is opened by 50%. FIG. 15C shows the aperture of the exit that is opened by 30%.

As shown in FIG. 15A, the development unit collection channel 72Y has a collection channel aperture section 72*a*Y that is an aperture section arranged near the exit thereof. The area of the aperture section 72*a*Y is adjusted by aperture section regulation cap 172Y that is a discharge capacity regulation member. The aperture section regulation cap 172Y shows a cylindrical profile so as to cover the development unit collection channel 72Y from outside and has a cap aperture section 172*a*Y. The cap aperture section 172*a*Y is so formed as to partly or entirely overlap the collection channel aperture section 72*a*Y. The area where the cap aperture section 172*a*Y overlaps the collection channel aperture section 72*a*Y can be modified to adjust the liquid developer discharge capacity by shifting the aperture section regulation cap 172Y and adjusting its position. Cam 173Y that is a discharge capacity regulation member abuts the end section 172*b*Y of the aperture section regulation cap 172Y. The cam 173Y is a circular member and its center of rotation 173*a*Y is arranged eccentrically relative to the center of the cam 173Y. The aperture section regulation cap 172Y is urged toward the cam 173Y by means of an elastic member (not shown) such as a spring.

Therefore, as the rotation angle of the cam 173Y is controlled and shifted, the aperture section regulation cap 172 that abuts on the cam 173Y is moved to change the area where the cap aperture section 172*a*Y overlaps the collection channel aperture section 72*a*Y. In this way, it is possible to control the flow rate of liquid developer.

The conveyance capacity can be controlled by controlling the open area of the collection channel aperture section 72*a*Y, keeping the number of revolutions per unit time of the collection auger 34Y to a constant value. For example, if it is determined in Step 13 that the image occupancy ratio is within either of the range between not less than 15% and less than 27% and the range exceeding 33% and not less than 45%, the cam 173Y is so controlled in Step 14 as to make the open area of the collection channel aperture section 72*a*Y to be equal to 50% of the area thereof as shown in FIG. 15B (ST14). If, on the other hand, it is determined in Step 13 that the image occupancy ratio is out of the range between not less than 15% and less than 27% and the range exceeding 33% and not less than 45% and hence the image occupancy ratio is less than 15% or exceeds 45%, the cam 173Y may be so controlled in Step 15 as to make the open area of the collection channel aperture section 72*a*Y to be equal to 30% of the area thereof as shown in FIG. 15C (ST15).

Note that the conveyance capacity regulation section according to the present invention includes the conveyance rate control device 100, the conveyance rate directing means 103 in particular, of the above-described embodiment. Also note that the concentration determination section of liquid developer includes the collected liquid developer concentration estimation means 101 and the collected concentration determination section of liquid developer 102. Additionally, the collection reservoir includes the collection section 13*b*Y and the discharge capacity regulation member includes the developer collection section motor 39*c*Y. The image information detection section includes the image occupancy ratio detection means 110 and the speed modification section includes the conveyance rate directing means 103.

Thus, the development device and the development section of the above-described embodiments can stabilize the concentration because they shows an improved effect of agitating and dispersing the liquid developer in a developer container without requiring addition of one or more members and/or modification of the configuration.

The image forming apparatus of the above-described embodiment can form a high-quality image at low cost because it shows an improved effect of agitating and dispersing the liquid developer in a developer container without requiring addition of one or more members and/or modification of the configuration and can reduce any abrupt fluctuations of the concentration of the liquid developer contained in the developer container.

What is claimed is:

1. An image forming apparatus comprising:

a development section that includes:

a developer carrier that carries liquid developer containing toner liquid and carrier liquid;

a developer supply member that supplies the liquid developer to the developer carrier;

a developer carrier cleaning member that collects the liquid developer from the developer carrier;

a collection reservoir that stores the liquid developer collected by the developer carrier cleaning member;

a supply section that makes the liquid developer flow to the collection reservoir; and a conveyance member that conveys the liquid developer collected in the collection reservoir in a first direction;

a conveyance capacity regulation section that regulates a conveyance capacity of the conveyance member;

a latent image carrier that carries a latent image to be developed by the developer carrier;

a charging section that electrically charges the latent image carrier;

an exposure section that exposes the latent image carrier that is electrically charged by the charging section to light;

a transfer member that transfers a developed image on the latent image carrier that is developed by the development section;

an image information detection section that detects image information; and a concentration determination section of liquid developer that determines a toner concentration of the liquid developer collected by the developer carrier cleaning member according to an outcome of detection of the image information detection section.

2. The apparatus according to claim 1, wherein the concentration determination section of liquid developer arithmetically determines the toner concentration of the liquid developer collected by the developer carrier cleaning member according to the outcome of detection of the image information detection section.

3. The apparatus according to claim 1, wherein the image information detection section computationally determines an image occupancy ratio by means of the number of dots printed on a single transfer medium.

4. The apparatus according to claim 1, wherein the conveyance capacity regulation section regulates of conveyance capacity of the conveyance member according to the toner concentration determined by the concentration determination section of liquid developer.

5. The apparatus according to claim 4, further comprising:

a speed modification section that is controlled by the conveyance capacity regulation section and regulates a rotational speed of the conveyance member.

6. The apparatus according to claim 4, further comprising:

an aperture section that discharges liquid developer from the collection reservoir; and a discharge capacity regulation member that is controlled by the conveyance capacity regulation section and covers the aperture section.

7. The apparatus according to claim 6, wherein the discharge capacity regulation member further including: a cap that covers the aperture section; and a cam that drives the cap to move.

8. The apparatus according to claim 1, wherein the conveyance member is an auger having a helical blade.

9. An image forming apparatus comprising:

a development section that includes:

a developer carrier that carries liquid developer containing toner liquid and carrier liquid;

a developer supply member that supplies the liquid developer to the developer carrier;

a developer carrier cleaning member that collects the liquid developer from the developer carrier;

a collection reservoir that stores the liquid developer collected by the developer carrier cleaning member;

a supply section that makes the liquid developer flow to the collection reservoir; and a conveyance member that conveys the liquid developer collected in the collection reservoir in a first direction;

a conveyance capacity regulation section that regulates a conveyance capacity of the conveyance member;

a latent image carrier that carries a latent image to be developed by the developer carrier;

a charging section that electrically charges the latent image carrier;

an exposure section that exposes the latent image carrier that is electrically charged by the charging section to light;

a transfer member that transfers a developed image on the latent image carrier that is developed by the development section; and a concentration determination section of liquid developer that measures the concentration of the liquid developer in the collection reservoir and determines the concentration of the liquid developer collected by the developer carrier cleaning member.

10. An image forming method comprising:

developing a latent image carried by a latent image carrier and exposed to light by an exposure section by means of a developer carrier;

detecting image information when performing an image forming operation of transferring a developed image onto a transfer medium;

determining a toner concentration of a liquid developer in a collection reservoir of a developer container according to an outcome of detection of the image information; and controlling a conveyance capacity of a conveyance member that conveys liquid developer from the collection reservoir according to the determined toner concentration.

11. The method according to claim 10, wherein the determining of the toner concentration arithmetically determines the toner concentration of the liquid developer in the collection reservoir of the developer container according to the outcome of detection of the image information.

* * * * *